US006899168B2

(12) United States Patent
Ghiani

(10) Patent No.: US 6,899,168 B2
(45) Date of Patent: May 31, 2005

(54) HEAT EXCHANGER AND A METHOD FOR PRODUCING A HEAT EXCHANGER

(75) Inventor: Franco Ghiani, Bietigheim-Bissingen (DE)

(73) Assignee: BEHR GmbH & Co., Stuttgart (DE)

( * ) Notice: Subject to any disclaimer, the term of this patent is extended or adjusted under 35 U.S.C. 154(b) by 152 days.

(21) Appl. No.: 10/158,896

(22) Filed: Jun. 3, 2002

(65) Prior Publication Data

US 2002/0139522 A1 Oct. 3, 2002

Related U.S. Application Data

(62) Division of application No. 08/752,147, filed on Nov. 19, 1996, now Pat. No. 6,397,937.

(51) Int. Cl.[7] ..... F28F 9/04

(52) U.S. Cl. ..... 165/148; 165/153; 165/173; 165/175

(58) Field of Search ..... 165/148, 153, 165/173, 175

(56) References Cited

U.S. PATENT DOCUMENTS

| | | | | |
|---|---|---|---|---|
| 3,016,230 A | * | 1/1962 | Cederstrom et al. | 165/148 |
| 3,021,804 A | | 2/1962 | Simpelaar | |
| 3,265,126 A | * | 8/1966 | Donaldson | 165/140 |
| 4,206,806 A | | 6/1980 | Togashi | |
| 5,069,277 A | | 12/1991 | Nakamura et al. | |
| 5,186,246 A | | 2/1993 | Halstead | |
| 5,251,374 A | | 10/1993 | Halstead et al. | |
| 5,252,778 A | * | 10/1993 | Ogawa | 174/16.1 |
| 5,279,360 A | | 1/1994 | Hughes et al. | |
| 5,329,990 A | | 7/1994 | Chigira | |
| 5,509,199 A | | 4/1996 | Beamer et al. | |
| 5,529,116 A | | 6/1996 | Sasaki et al. | |
| 5,537,839 A | | 7/1996 | Burk et al. | |

FOREIGN PATENT DOCUMENTS

| | | |
|---|---|---|
| DE | 1 277 282 | 9/1968 |
| DE | 26 11 397 | 9/1976 |
| DE | 91 11 412.8 | 10/1991 |
| DE | 42 38 853 | 5/1994 |
| EP | 0 253 167 | 1/1988 |
| FR | 2 664 371 | 1/1992 |
| JP | 63-169497 | 7/1988 |
| JP | 1-247990 | 10/1989 |

OTHER PUBLICATIONS

Josef Kern et al., "State of the Art and Future Developments of Aluminum Radiators for Cars and Trucks," SAE Technical Paper Series 931092, Vehicle Thermal Management Systems Conference, Columbus, Ohio, 1993, pp. 187–197.

Roland Burk, "Consenser Module for Automotive Air–Conditioners," ATZ Automobiltechnische Zeitschrift, vol. 97, No. 5, Franckh–Kosmos Verlags–GmbH & Co., 1995, pp. 2–5.

* cited by examiner

*Primary Examiner*—Allen Flanigan
(74) *Attorney, Agent, or Firm*—Foley & Lardner LLP

(57) ABSTRACT

A heat exchanger is assembled in a simple and cost-effective way and needs a relatively low space requirement. According to the invention, the tubes (11) are expanded at the tube ends (16) in such a way that the tube ends (16) are of rectangular design in cross section. The tube ends (16) have parallel long connecting surfaces (18) which are brought into bearing contact with long connecting surfaces (18) of adjacent tube ends (16). Furthermore, the tube ends (16) have short connecting surfaces (22), onto which the collecting tanks (23, 29) are placed with their legs (24, 25) or collars (30, 31). A space-saving heat exchanger can be produced in a simple way by soldering the long connecting surfaces (18) together, on the one hand, and by soldering the short connecting surfaces (22) to the collecting tanks (23, 29), on the other hand.

18 Claims, 5 Drawing Sheets

HEAT EXCHANGER AND A METHOD FOR PRODUCING A HEAT EXCHANGER

BACKGROUND OF THE INVENTION

The present invention relates to a heat exchanger of the general type having a plurality of tubes of generally rectangular or oval cross section, which run parallel to one another and have a longitudinal side and a narrow side; a first collecting tank attached to the tubes at a first end of each tube; and heat exchange ribs bearing on the tubes. The invention also relates to a method for producing a heat exchanger and to an arrangement of a first heat exchanger in relation to a second heat exchanger.

It is known that a heat exchanger consists of a tube bundle of rectangular or flatly oval tubes, ribs or fins being arranged between the tubes. At the opposite tube ends, the tubes are enclosed in a header or tube frame. This header has in the longitudinal direction, at each edge, a projecting U-shaped collar for receiving the hood-shaped collecting tank or header tank. After the tube ends have been connected to the header, the collecting tank is placed with its legs onto the U-shaped collar of the header and is flanged to the latter. One disadvantage of the known heat exchanger is that the projecting design of the header makes an increased space requirement necessary for the heat exchanger.

German Offenlegungsschrift No. 26 11 397 discloses a heat exchanger, in which the tubes running parallel bear on one another and are welded together in the region of the tube ends by means of connecting surfaces in each case. A disadvantage of this known heat exchanger, however, is that the tube ends are enclosed in a frame which projects at the edge. The design of the known heat exchanger consequently cannot lead to a reduction in its space requirement.

SUMMARY OF THE INVENTION

Therefore, one object of the present invention is to provide an improved heat exchanger design. A further object of the invention resides in the provision of an improved arrangement of heat exchangers. Still another object of the invention is to provide an improved method for producing a heat exchanger, such that heat exchangers can be produced in a simple way and cost-effectively, along with a low space requirement.

In accomplishing these and other objects, there has been provided according to one aspect of the present invention a heat exchanger comprising: a plurality of tubes of generally rectangular or oval cross section, which run parallel to one another and have a longitudinal side and a narrow side; a first collecting tank attached to the tubes at a first end of each tube; and heat exchange ribs bearing on the tubes, wherein the tubes are expanded at the tube ends in a direction perpendicular to the longitudinal side to form at least one generally planar first connecting surface for bearing on and being connected to an adjacent connecting surface of the tube end of an adjacent tube, and wherein at least one narrow side of the tube end forms a second connecting surface for connection to the collecting tank.

In accordance with another aspect of the invention, there has been provided a method for producing a heat exchanger of according to the invention, comprising: transversely expanding the tube ends relative to the longitudinal direction of the tubes to form tube ends of rectangular cross section; placing either a preformed collecting tank or a bracket for receiving a collecting tank onto a tube bundle formed from the parallel tubes and from the ribs, this tank or bracket having leg ends bearing on the second connecting surfaces; and then simultaneously brazing the first connecting surfaces of the adjacent tube ends and the second connecting surfaces to the leg ends.

In accordance with still another aspect of the invention, there has been provided an arrangement of a first heat exchanger of the type according to the invention, relative to a second heat exchanger, wherein the first heat exchanger is connected to the second heat exchanger by a connecting element extending from the collecting tank of the first heat exchanger to an adjacent collecting tank of the second heat exchanger.

Further objects, features and advantages of the present invention will become apparent from the detailed description of preferred embodiments that follows, when considered together with the attached figures of drawing.

DETAILED DESCRIPTION OF PREFERRED EMBODIMENTS

Figure 1:
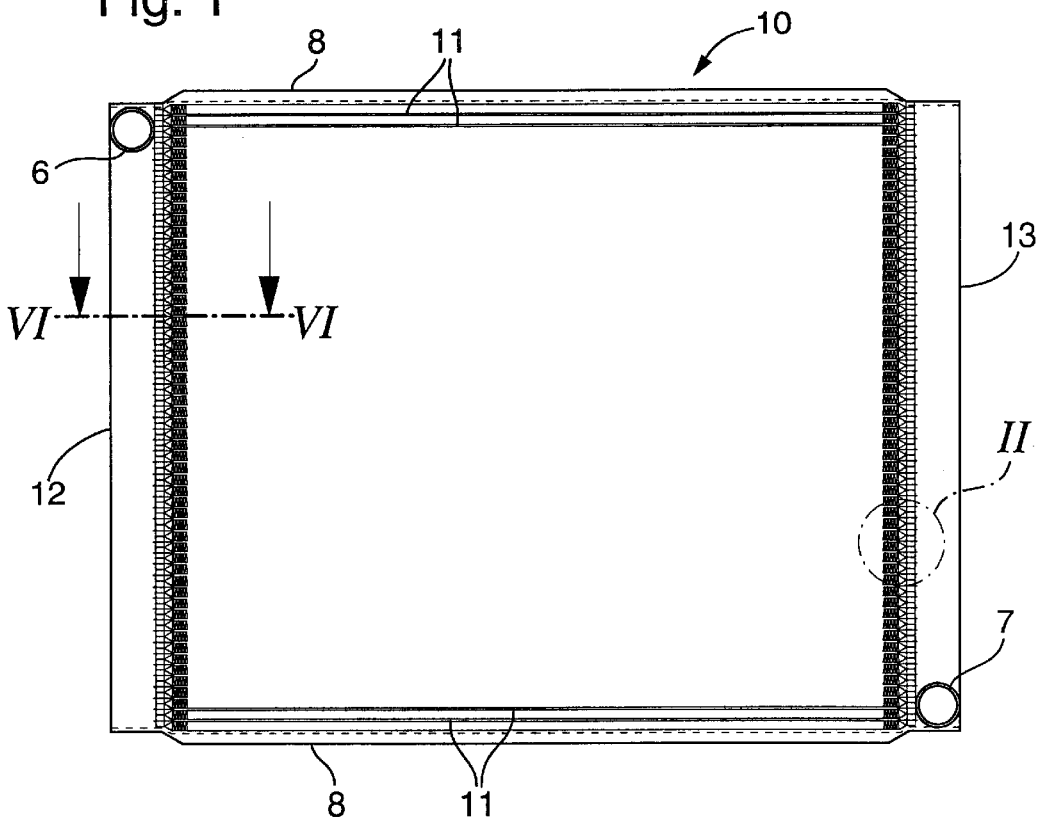
FIG. 1 is a front view, partially cut-way, of a heat exchanger according to the invention.

According to the invention, the tubes are expanded at the tube ends in such a way that, on the one hand, long connecting surfaces are formed for connecting the tube ends to adjacent tube ends and, on the other hand, short connecting surfaces are formed for connection to a collecting tank attached at the end regions of the tubes. The tube end is expanded perpendicularly to the longitudinal side of the tube, narrowing occurring perpendicularly to the narrow side of the tube. The widening of the tube perpendicularly to the longitudinal side of the tube makes it possible for the long connecting surfaces of one tube end to come into direct bearing contact with a connecting surface of an adjacent tube end. The provision of a header can therefore be dispensed with. Furthermore, the collecting tank can be connected to the tube block directly on the outer connecting surfaces, in particular on the short connecting surfaces, which extend in the transverse direction of the tube, with the spatial extent of the tube perpendicularly to the narrow side being reduced. An appreciable reduction in the space requirement of the heat exchanger in terms of its depth is thereby achieved. In addition, the direct bearing of the collecting tank on the short connecting surfaces makes it possible to dispense with a tube frame, so that material is saved.

According to one advantageous design of the invention, the narrowing on the narrow sides of the tube is dimensioned in such a way that it is greater than or equal to the leg thickness of the collecting tank. This ensures that the heat exchanger is not designed with a total depth greater than the tube block depth.

According to another advantageous development of the invention, the tubes, ribs and collecting tank consist of a pure metal material, so that the heat exchanger can be recycled in a simple way. Advantageously, the tubes, ribs and collecting tank consist of an aluminum alloy, in order to achieve as great a weight reduction as possible.

The method according to the invention for producing the heat exchanger affords, in particular, the advantage that the number of production steps can be reduced. After the tube ends have been expanded, the tube bundle consisting of tubes and ribs is introduced, together with the collecting tank placed on it, into a brazing furnace, in which the parts to be connected are soldered together simultaneously in one work step.

Exemplary embodiments of the invention are illustrated in the drawings and are described in more detail below.

Turning now to the drawings, FIG. 1 shows a front view of a heat exchanger 10 with tubes 11 which run parallel and which extend from a collecting tank 12 to an opposite collecting tank 13, said heat exchanger being capable of being employed for engine cooling in automotive technology. Side parts 8 limit the heat exchanger 10 in the vertical direction and are in each case connected to the collecting tanks 12 and 13 at the ends. The collecting tank 12 has, in one end region, a feed connection piece 6 for feeding a cooling medium into the collecting tank 12. The cooling medium is distributed in the collecting tank 12 and is led via the tubes 11 to the second collecting tank 13, from which it is led out of the collecting tank 13 via a discharge connecting piece 7.

Figure 2:
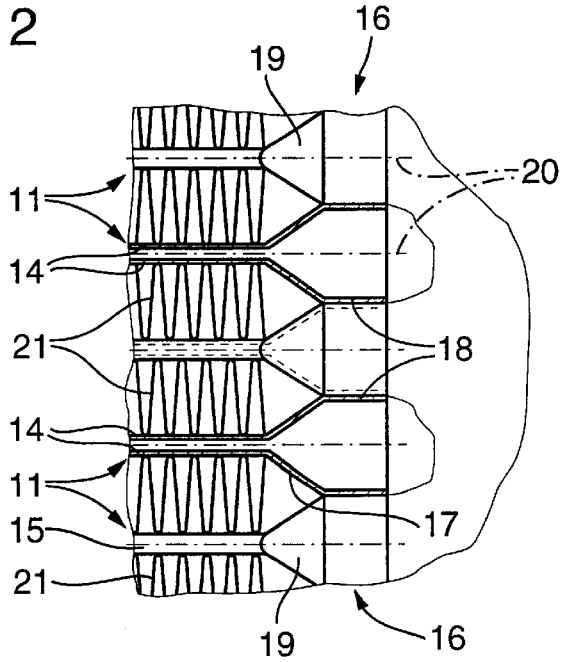
FIG. 2 is a cross-sectional representation, in enlarged detail, illustrating the region II in FIG. 1 in a side view of a row of tubes in one end region with two tube ends.
Figure 3:
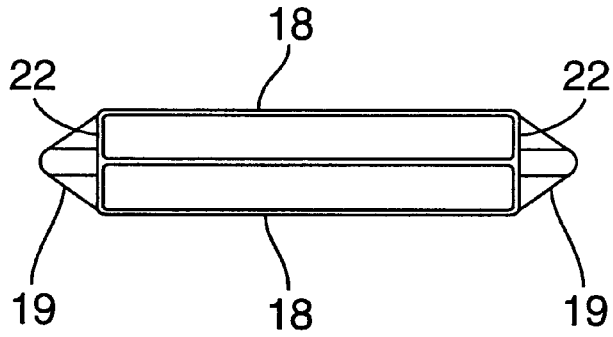
FIG. 3 is a side view of a tube end.

As is evident from FIG. 2 and FIG. 3, the tubes 11 are designed as flatly oval or, in cross section, rectangular tubes, with opposite longitudinal sides 14 and laterally arranged narrow sides 15. In an end region, the tube ends 16 are of a design expanded perpendicularly to the longitudinal side 14. The longitudinal sides 14 of the tube 11 extend via conically shaped long transitional surfaces 17 to long connecting surfaces 18 of the tube end 16. The narrow sides 15 of the tube 11 narrow in the direction of the tube end 16, via a short transitional surface 19 extending conically in the direction of a mid-axis 20 of the tube 11, to a short connecting surface 22. The tubes 11 are arranged in a row, air-conducting corrugated ribs 21 being arranged between the tubes 11. While the longitudinal sides 14 are expanded to form a long connecting surface 18, the narrow sides 15 are laterally narrowed to form a short connecting surface 22. As is evident from FIG. 3, the tube end 16 is designed with a rectangular cross section, specifically in the form of the opposite long connecting surface 18 running parallel and of the opposite short connecting surface 22 arranged at right angles thereto. Expansion is carried out in such a way that the circumferential length of the tube end 16 along the long and short connecting surfaces 18 and 22 is equal to the circumferential area of the tube 11 in the region of the longitudinal and narrow sides 14 and 15, so that the thickness of the long and short connecting surfaces 18 and 22 is equal to the thickness of the longitudinal and narrow sides 14 and 15. There is no enlargement of the surface of the tube 11 at the tube ends 16.

As can be seen from FIG. 2, the long connecting surfaces 18 bear on the long connecting surfaces 18 of adjacent tube ends 16 and are connected to these by brazing. The inclination of the conical long transitional surfaces 17 is determined by the width of the corrugated ribs 21. The greater the depth of the corrugated ribs 21, the larger the angle of the long transitional surfaces 17 relative to the mid-axis 20 must be, so that the adjacent long connecting surfaces 18 can bear on one another.

Figure 4:
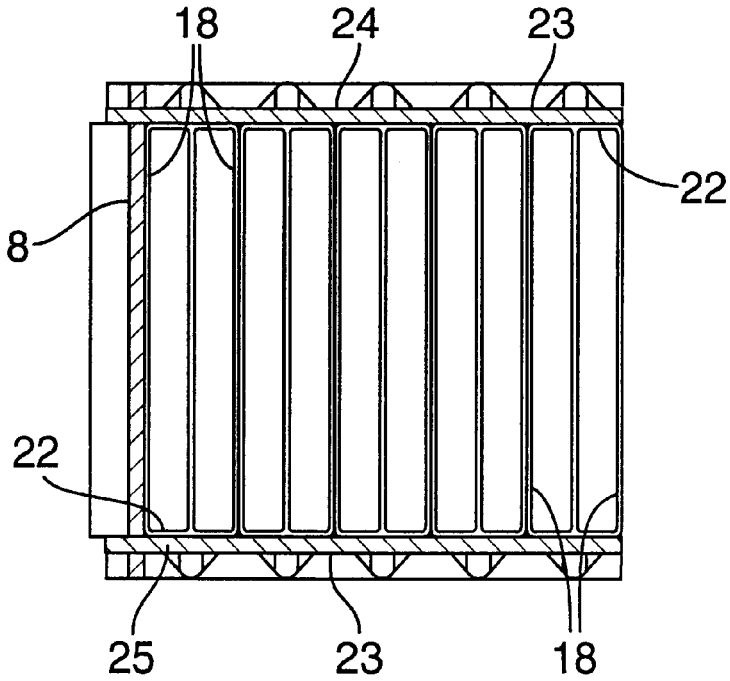
FIG. 4 is a partial cross-sectional view taken through the heat exchanger along the line IV—IV of FIG. 6, with a U-shaped collecting tank in one end region.
Figure 6:
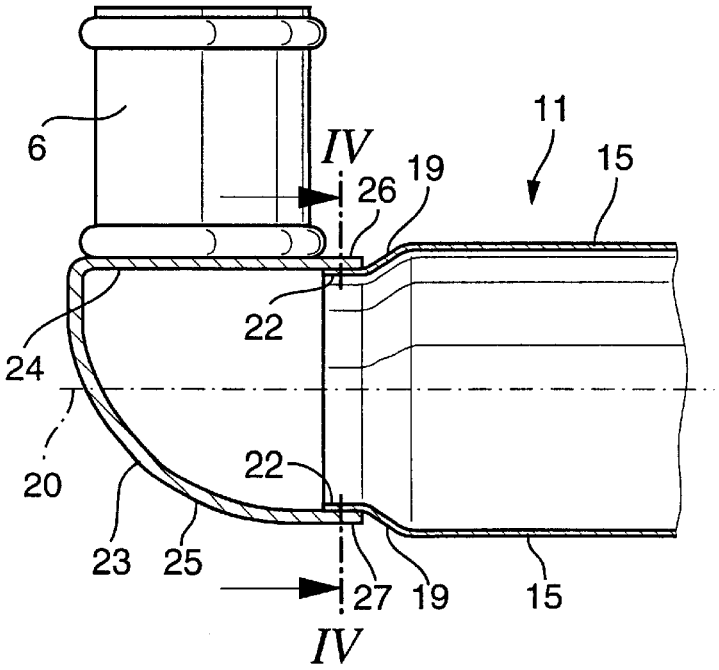
FIG. 6 is a partial cross-sectional view taken through a heat exchanger along the line VI—VI of FIG. 1, with a U-shaped collecting tank.

According to a first exemplary embodiment shown in FIG. 4 and FIG. 6, a U-shaped collecting tank 23 having a planar leg 24 and a curved leg 25 is placed onto the tube ends 16. The leg ends 26 and 27 bear on the short connecting surfaces 22 and are soldered to these. On the end faces, the leg ends 26 and 27 are fitted positively into grooves of the side part 8 which are provided for this purpose, and are simultaneously connected to said grooves by brazing. Since the short connecting surfaces 22 are arranged inwardly or convergingly in the direction of the mid-axis 20, in comparison with the narrow sides 15, and since the reduction in distance from the mid-axis 20 is at least equal to or greater than the thickness of the leg ends 26, 27, the collecting tank 23 does not project in the lateral direction beyond the edges of tubes 11. The lateral extent of the collecting tanks 23 is therefore equal to or smaller than the transverse extent of the tubes 11. A considerable reduction in the space requirement of the heat exchanger 10 is consequently ensured, since the space requirement is determined merely by the depth of the tubes 11 (distance of the narrow sides 15 from the opposite narrow side 15). The feed connection piece 6 for feeding a cooling medium is advantageously mounted on the planar leg 24 of the collecting tank 23.

Advantageously, the collecting tank 23 is produced by extruding a block to form a U-shaped profile. Furthermore, the collecting tank 23 can also be formed by rolling and subsequent bending, in particular by deep drawing. In this case, it is necessary to ensure that, by bringing a suitable tool to bear in the lateral direction, namely on the short connecting surfaces 22, the latter are arranged perpendicularly to the long connecting surfaces 17, so that the edge between a short connecting surface 22 and a long connecting surface 17 has a small radius. This prevents the formation of an interspace or gap, so that the leg ends 26, 27 of the collecting tank 23 are sealingly connected to the short connecting surfaces 22 of the tube block by brazing.

Figure 5:
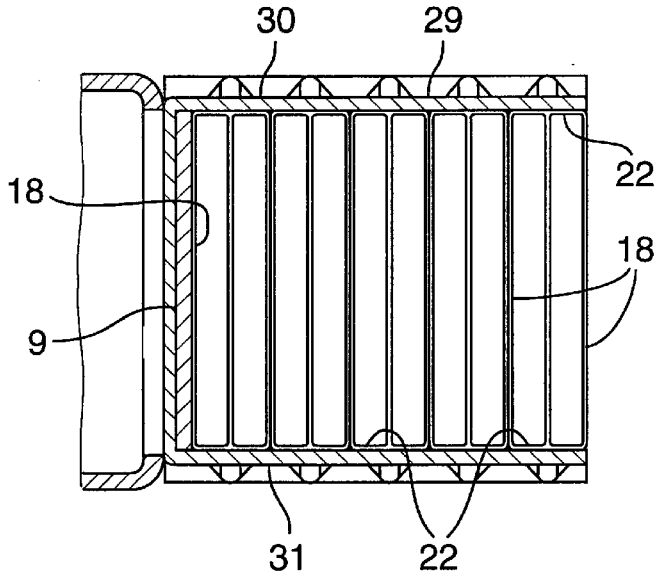
FIG. 5 is a partial cross-sectional view taken through the heat exchanger along the line V—V of FIG. 7, with a cylindrical collecting tank in one end region.
Figure 7:
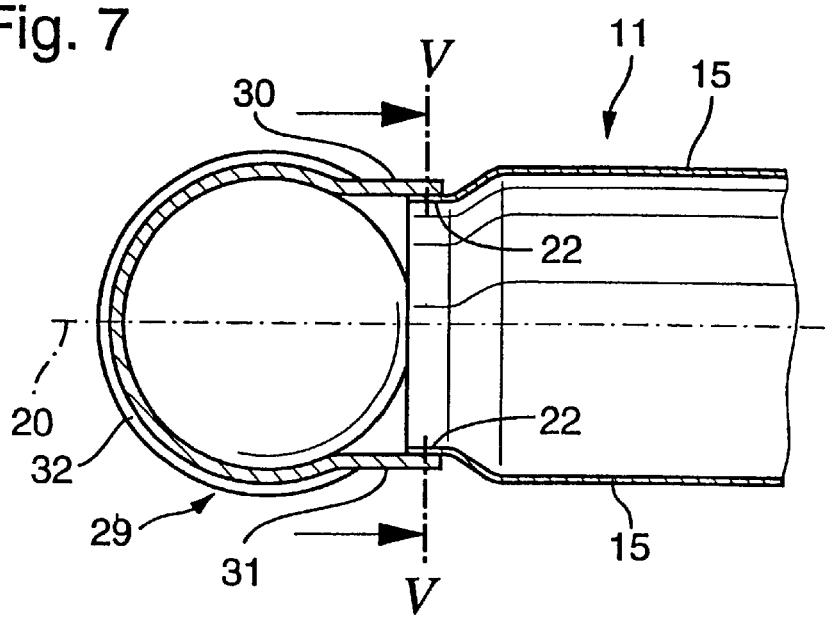
FIG. 7 is a partial cross-sectional view of a top view of a heat exchanger with a cylindrical collecting tank.

Alternatively, according to a second exemplary embodiment shown in FIG. 5 and FIG. 7, the collecting tank can be designed as a cylindrical collecting tank 29. This collecting tank 29 is preferably produced by deep drawing. Parallel collars 30 and 31 form a recess of the collecting tank 29, into which recess the tube bundle is inserted, with the short connecting surfaces 22 coming to bear on the insides of the collars 30 and 31. Depending on the instance of use, the end faces of the collecting tank 29 are connected sealingly to an outer surface 32 of the collecting tank 29. For the supply and discharge of a cooling medium, the collecting tank 29 can have, in the region of one end face, an axial recess for the bearing of a connection piece (not shown). The collecting tank 29 surrounds, with its end faces, the side part 8 bearing on the outer long connecting surface 18 and is connected to these by brazing. By surrounding the tube bundle, on the one hand, and the side part 8, on the other hand, an accurate fit of the tube bundle relative to opposite side parts 8 is achieved in a simple way, so that the connection of these components to one another can subsequently be carried out in one operation.

Preferably, the tube bundle, composed of the corrugated ribs 21 and the tubes 11, and the collecting tanks 12, 13, 23 or 29, consist of a single pure metal material. It thereby becomes easier for the heat exchanger 10 to be recycled. The preferred material used for these components is an aluminum alloy which allows a weight reduction of the heat exchanger 10, in particular when it is used in automobile construction. In addition, the use of other recyclable materials is possible. Materials from copper or steel can also be used for the tubes and plastic can be used for the collecting tank, the tubes or the tube bundle being adhesively bonded to the collecting tank.

The method for producing the heat exchanger 10 is illustrated below. After the collecting tanks 12, 13, 23 or 29 of varying shape, provided for connection to the tubes 11, have been formed accurately to fit by, e.g., deep drawing or extrusion, the tube block is inserted with the expanded tube ends 16 into those recesses of the collecting tanks 23 or 29 which are provided for this purpose. Thereafter, simultaneously, the tube ends 16 are connected to one another on the long connecting surfaces 18 and the tube ends 16 are connected to the collecting tank 23 or 29 on the short connecting surfaces 19. This connection is preferably made by brazing, at least the relevant connection points having previously been sprayed with a flux. This flux is preferably noncorrosive. However, other brazing methods included in this invention are also suitable for connecting the relevant parts.

Advantageously, the heat exchanger 10 can be connected to a second directly adjoining heat exchanger 28. This heat exchanger 28 can, for example, be a condenser of an air-conditioning system or a charge cooler. The heat exchanger 10 can be designed either with a U-shaped collecting tank 23 or with a cylindrical collecting tank 29.

Figure 8:
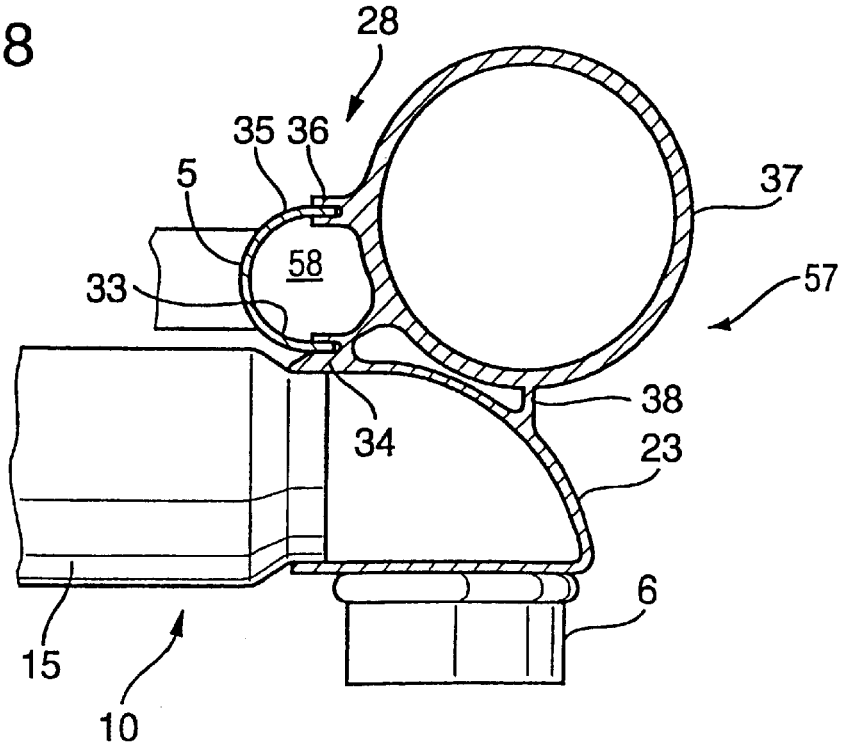
FIG. 8 is a partial cross-sectional view of a top view of an arrangement of two adjacent heat exchangers according to a first exemplary embodiment.

According to a first exemplary embodiment shown in FIG. 8, the first heat exchanger 10 is connected to the second heat exchanger 28 through an integrally formed member 57 which defines a collecting tank 23 for the first heat exchanger 10, a second collection tank 58 formed in part by a tube receiving member 5, whose legs 33, 35 are received in grooves 34, 36 formed in the integrally formed member. The integrally formed member also defines a collector 37 which may communicate with the second collection tank to collect liquid condensate, for example. Integrally formed web 38 connects the collector 37 to the collector tank 23.

Figure 9:
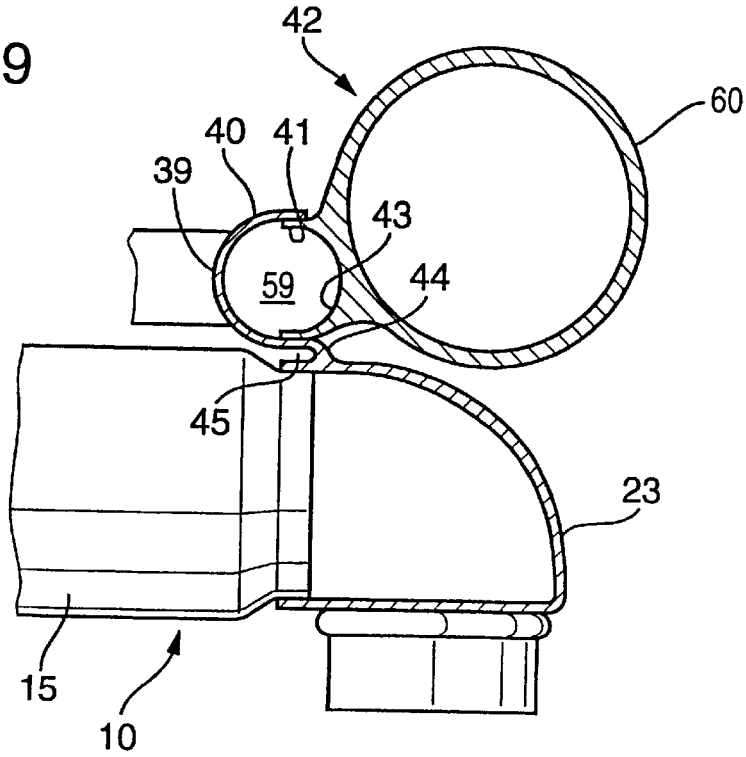
FIG. 9 is a partial cross-sectional view of a top view of an arrangement of two adjacent heat exchangers according to a second exemplary embodiment.

According to a further exemplary embodiment shown in FIG. 9, the heat exchanger 10 is integrally connected to heat exchanger 42 via a U-shaped connecting element 39 which also serves as the tube-receiving member of the second collection tank 59 of heat exchanger 42. This exchanger may also include a collector 60 which may be hydraulically connected to the second collection tank 59 and serve to collect liquid condensate, for example. The noses 41 and 43 of the heat exchanger 42 are connected respectively to the leg 40 and to the extension piece 44 of the heat exchanger 10 by brazing, this brazing operation preferably taking place simultaneously with the brazing operation for forming the heat exchanger 10. The extension piece 44 preferably has a recess 45 which serves, after the connection of the heat exchanger set formed from the heat exchanger 10 and from the heat exchanger 42, for locating a possible leaky point more simply during a leakage test.

The heat exchangers 28 and 42 preferably consist of an aluminum alloy, at least the points to be connected being provided with a noncorrosive flux. Thus, the combination of a first heat exchanger 10 with a heat exchanger 28 or 42 can be produced in a simple way in a single work step in each case.

Figure 10:
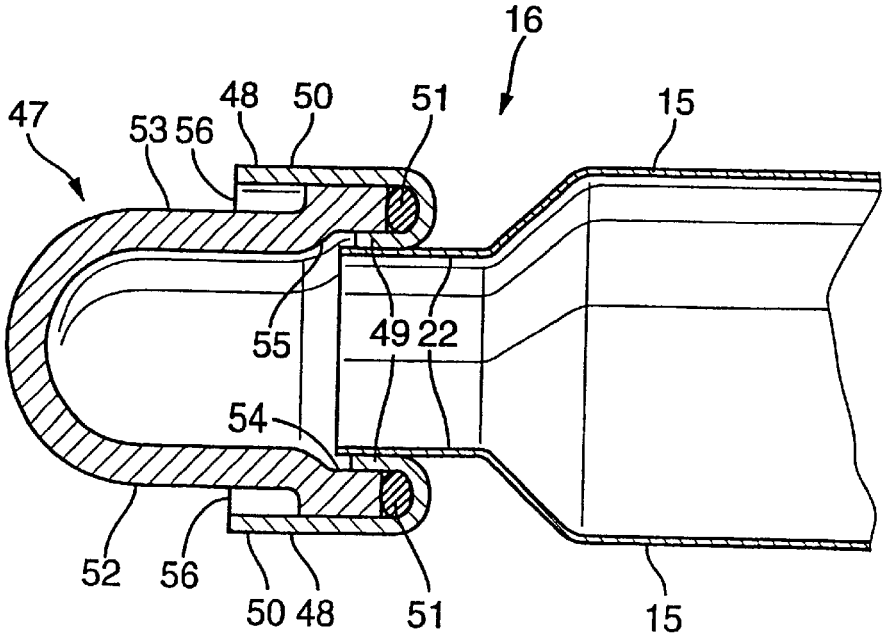
FIG. 10 is a partial cross-sectional view of a top view of a heat exchanger with a further U-shaped collecting tank.

According to a further exemplary embodiment of the heat exchanger shown in FIG. 10, a U-shaped collecting tank 47 is connected to the tube bundle in each case in the lateral region via a likewise U-shaped extension piece 48. The collecting tank 47 can in this case be designed as diecasting material or as a plastic part. In the region of the tube end 16, the extension piece 48 is placed with a short leg 49 onto the short connecting surfaces 22 and is connected thereto by brazing. A long leg 50 of the extension piece 48 extends parallel to the narrow side 15 of the tube 11, the distance between the outer contours of the long and short legs 49, 50 being shorter than or equal to the distance between the short connecting surface 22 and an imaginary prolongation of the narrow side 15. To connect the collecting tank 47 to the extension piece 48, a continuous sealing ring 51 is inserted into the groove formed by the extension piece 48, and thereafter the collecting tank 47 is pressed with its two legs 52, 53 onto the sealing ring 51 and fixedly connected to the extension piece 48 by flanging together with or crimping the long legs 50 of the latter. The legs 52, 53 have leg ends 54 and 55 which are inserted into the groove of the extension piece 48 in alignment with said groove. In this case, an inner side of the leg ends 54, 55 bears on the short leg 49 of the extension piece 48 and an outer side of the leg ends 54, 55 bears on the long leg 50 of the extension piece 48. The planar bottom sides of the leg ends 54, 55 are pressed onto the sealing ring 51 and are held in the groove by subsequent flanging or crimping, so that reliable leakproofing of the collecting tank 47 is ensured. The flanging or crimping of the collecting tank 47 is carried out by means of a tool engaging on the outside of the long legs 50 of the extension piece 48, the long leg 50 being pressed inwardly in places to form a flanged edge 56.

According to this exemplary embodiment, a space-saving heat exchanger is produced in a simple way, a collecting tank 47 engaging with its ends 54, 55 into a groove of an extension piece 48 connected to the tube bundle.

The right of priority based upon German patent application No. 195 43 986.4, filed Nov. 25, 1995, is hereby claimed.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

What is claimed is:

1. A light weight automotive vehicle heat exchanger assembly comprising:

a heat exchanger comprising:

a plurality of tubes each having a generally rectangular or oval cross section, and a pair of opposing longitudinal sides each having a first width and a pair of opposing narrow sides each having a second width;

a first collecting tank attached to the plurality of tubes at a first end of each of the plurality of tubes, with the plurality of tubes positioned parallel to each other; and heat exchange fins positioned between the plurality of tubes, wherein each of the plurality of tubes has a substantially rectangular cross section at the first tube end, forming two generally opposing planar first connecting surfaces that bear on and connect to adjacent connecting surfaces of the tube ends of adjacent tubes, and forming two generally opposing planar second connecting surfaces that connect to the first collecting tank, wherein the first connecting surface is connected to the adjacent connecting surface of the adjacent tube end by brazing, wherein the first connecting surface has a third width and the second connecting surface has a fourth width, wherein the third width is greater than the fourth width, the first width is greater than the third width, and the fourth width is greater than the second width, and wherein a first perimeter of the tube defined by the first and second widths of the pair of opposing longitudinal sides and the pair of opposing narrow sides and a second perimeter of the first tube end defined by the third and fourth widths of the opposing first and second connecting surfaces are substantially the same to maintain a substantially constant tube wall thickness.

2. A heat exchanger as claimed in claim 1, wherein the first tube end has longer transitional regions defined by opposing transitional surfaces extending outwardly from the pair of opposing longitudinal sides to the first opposing connecting surfaces, and has shorter transitional surfaces extending inwardly from the pair of opposing narrow sides to the second opposing connecting surfaces, toward a longitudinal mid-axis of the tube.

3. A heat exchanger as claimed in claim 2, wherein the first connecting surfaces are connected to adjacent first connecting surfaces of adjacent first tube ends such that the second connecting surfaces are flush with adjacent second connecting surfaces of adjacent first tube ends.

4. A heat exchanger as claimed in claim 3, wherein the second connecting surfaces are connected to the first collecting tank by brazing.

5. A heat exchanger as claimed in claim 1, wherein the first collecting tank has opposing leg ends, the second connecting surfaces being connected to the leg ends of the first collecting tank either directly or indirectly by brazing.

6. A heat exchanger as claimed in claim 1, wherein the tubes, the fins, and the first collecting tank are made of the same metal material.

7. A heat exchanger as claimed in claim 6, wherein the tubes, the fins, and the first collecting tank are made of an aluminum alloy, whereby the heat exchanger is recyclable as a single unit.

8. A heat exchanger as claimed in claim 1, wherein the first collecting tank is generally cylindrical with opposite end faces and with an outer surface, the outer surface having two opposite parallel collars for bearing on and connection to the second connecting surfaces.

9. A heat exchanger assembly as claimed in claim 1, wherein the first collection tank has a U-shaped profile with a planar leg and an arcuate leg, the legs having, in an end region, parallel leg ends that bear on and connect to the second connecting surfaces.

10. A method for producing a heat exchanger as claimed in claim 1, comprising:

transversely expanding the first tube ends relative to the longitudinal direction of the tubes to form tube ends of rectangular cross section;

placing either a preformed collecting tank or a bracket for receiving a collecting tank onto a tube bundle formed from the parallel tubes and from the ribs, said tank or bracket having leg ends bearing on the second connecting surfaces; and then simultaneously brazing the first connecting surfaces of the adjacent tube ends and the second connecting surfaces to the leg ends.

11. A method as claimed in claim 10, further comprising the step of applying to at least the parts to be brazed a noncorrosive flux, so that they are brazed to one another solely by the supply of heat.

12. A method as claimed in claim 10, wherein said tank comprises a sheet metal blank formed into a cylindrical collecting tank by deep drawing.

13. A method as claimed in claim 10, wherein said tank comprises a metallic material extruded to form a U-shaped profile as a U-shaped collecting tank.

14. A heat exchanger as claimed in claim 1, wherein the first collection tank comprises a U-shaped extension member having a first leg and a second leg, wherein the second connecting surfaces are connected to the leg ends.

15. A heat exchanger as claimed in claim 14, wherein the U-shaped extension member has a groove and a ring positioned in the groove of the U-shaped extension member.

16. A heat exchanger as claimed in claim 14, wherein the first and second legs are connected to the second connecting surfaces by brazing.

17. A light weight recyclable automotive vehicle heat exchanger assembly comprising:

a heat exchanger comprising:

a plurality of tubes each having a generally rectangular or oval cross section, and a pair of opposing longitudinal sides each having a first width and a pair of opposing narrow sides each having a second width;

a first collecting tank attached to the plurality of tubes at a first end of each of the plurality of tubes, with the plurality of tubes positioned parallel to each other; and heat exchange fins positioned between the plurality of tubes, wherein each of the plurality of tubes has a substantially rectangular cross section at the first tube end, forming two generally opposing planar first connecting surfaces that bear on and directly connect to adjacent connecting surfaces of the tube ends of adjacent tubes by brazing, and forming two generally opposing planar second connecting surfaces that are directly connected to the first collecting tank by brazing, wherein the plurality of tubes and the first collecting tank are made of an aluminum alloy, wherein the first connecting surface has a third width and the second connecting surface has a fourth width, wherein the third width is greater than the fourth width, the first width is greater than the third width, and the fourth width is greater than the second width, and wherein a first perimeter of the tube defined by the first and second widths of the pair of opposing longitudinal sides and the pair of opposing narrow sides and a second perimeter of the first tube end defined by the third and fourth widths of the opposing first and second connecting surfaces are substantially the same to maintain a substantially constant tube wall thickness.

18. A heat exchanger as claimed in claim 1, wherein said first collecting tank has a width dimension and a length dimension that is larger than said width dimension, and wherein the width dimension at its largest point is not larger than said first width of said tubes, whereby a space saving is provided in the dimension of the heat exchanger.

* * * * *